United States Patent [19]

Hemfort et al.

[11] 3,981,437

[45] Sept. 21, 1976

[54] CENTRIFUGE HAVING A SYSTEM FOR CONTROLLING THE TEMPERATURE OF THE LIQUID TO BE CENTRIFUGED OR OF ONE OF THE COMPONENTS THEREOF

[75] Inventors: Heinrich Hemfort; Gunthard Pautsch; Werner Kohlstette, all of Oelde, Germany

[73] Assignee: Westfalia Separator AG, Oelde, Germany

[22] Filed: Apr. 28, 1975

[21] Appl. No.: 572,688

[30] Foreign Application Priority Data

May 14, 1974 Germany ..... 2423319

[52] U.S. Cl. ..... 233/11

[51] Int. Cl.[2] ..... B04B 15/02

[58] Field of Search ..... 233/11, 1 R, 27, 1 A, 233/19 R, 14 R

[56] References Cited

UNITED STATES PATENTS

| | | | |
|---|---|---|---|
| 1,482,229 | 1/1924 | Hapgood | 233/11 |
| 1,897,613 | 2/1933 | Jensen | 233/11 X |
| 2,488,747 | 11/1949 | Strezynski | 233/14 R |
| 2,765,978 | 10/1956 | Strezynski | 233/11 |
| 2,917,229 | 12/1959 | Di Benedetto et al. | 233/11 |
| 3,092,180 | 6/1963 | Dahlgren | 233/11 X |
| 3,255,805 | 6/1966 | Bechard | 233/11 X |

*Primary Examiner*—George H. Krizmanich
*Attorney, Agent, or Firm*—Burgess, Dinklage & Sprung

[57] ABSTRACT

Centrifuge with a drum having an insert lining spaced from and supported on the drum wall for flow of a heat exchange medium through the passage between the drum and insert. The drum is jacketed by a stationary frame member outfitted with heat exchange means, and the outlet from the passage in the drum communicates with the passage provided by the jacket. After flowing down the jacket, the heat exchange medium is pumped back to the passage in the drum.

6 Claims, 3 Drawing Figures

Figure 1:
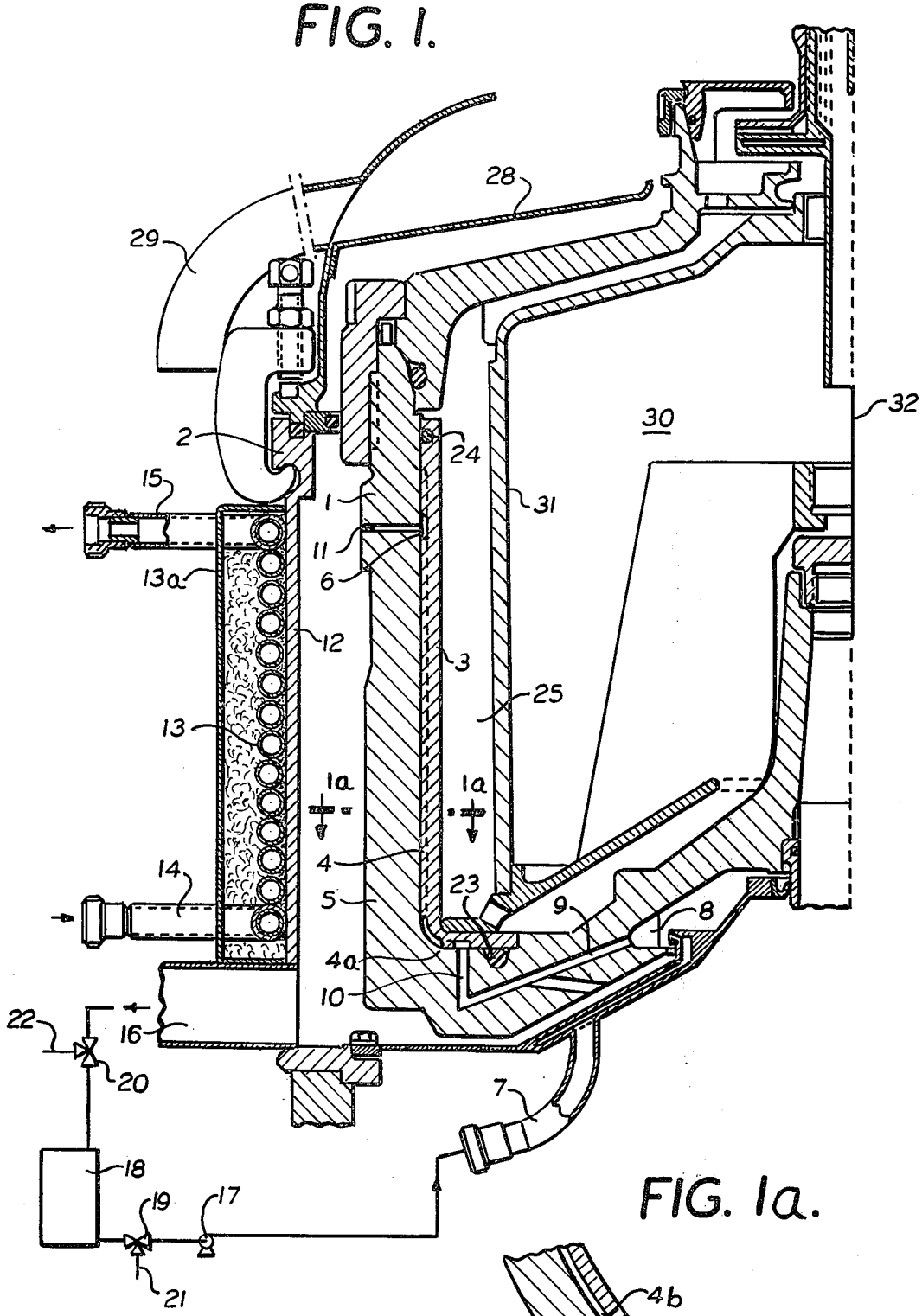

CENTRIFUGE HAVING A SYSTEM FOR CONTROLLING THE TEMPERATURE OF THE LIQUID TO BE CENTRIFUGED OR OF ONE OF THE COMPONENTS THEREOF

BACKGROUND

The invention relates to a centrifuge having a system for controlling the temperature of the liquid to be centrifuged or of one of the components thereof, consisting of an insert which is inserted into the drum and whose outer periphery forms at least one passage which is provided with an inlet and a discharge for the temperature control medium and is separated from the separating chamber of the drum.

Such a centrifuge is known, for example, from German Pat. No. 437,482. The temperature control system is intended for the purpose of delivering heat to the solids of low melting point which are separated from the liquid being centrifuged and collect in the peripheral part of the drum, in order to make them fluid and continuously removable.

In the pharmaceutical industry it is necessary in many cases to keep the temperature of the liquid as constant as possible during the centrifuging operation, after the temperature has been established at a certain level. This is the case, for example, with human blood, when certain proteins are to be precipitated from the plasma thereof at different temperatures and removed by centrifugation for use in combatting certain diseases. The blood which is collected, and must be kept at a low temperature, is adjusted to the temperature required for the removal of a specific protein, and it must be maintained at that level within no more than fractions of a degree during the centrifugation if the protein in question is to be obtained in pure form. Since the winning of the individual fractions takes place at relatively low temperatures, the blood must be prevented from heating during centrifugation.

It is known that the friction between a rotating body and the air surrounding it depends to a great extent on its diameter. A drum of average size can be warmed by such friction to temperatures of as much as about 80°C. Due to the high heat transfer coefficient of the drum material, the friction heat which thus develops is transfered to the liquid being centrifuged, and the lower the throughput is, the higher the temperature of the liquid will become. But since blood centrifuges have to be operated at a low throughput, special precautions must be taken to prevent warming of the blood during centrifugation. Without such measures the fractionation of human blood by centrifugation is simply impossible.

Although the apparatus known from German Pat. No. 437,482 is fundamentally capable of being charged with a cooling liquid, it is unsuited for coolants having a low vaporization point. The warming of the drum periphery itself is not counteracted, so that the coolant exceeding the vaporization point would pass out in vapor form into the catcher and would not be able to be recovered, not to mention the fact that the vapors may result in a hazardous contamination of the air in the work room. This known temperature control system furthermore has the disadvantage that the insert would collapse under the pressure of the drum charge due to the lack of support of its inner wall, if the channels were to empty themselves. To prevent such collapse the inlet outlet are drawn far inwardly so that the passages will remain filled after the temperature control medium is shut off. This simultaneously prevents the temperature control medium from mixing with the liquid being centrifuged.

On the other hand, experiments have shown that the warming of the drum periphery virtually cannot be prevented by a cooling jacket disposed in the frame surrounding the drum. The heat transfer coefficient of the air between the drum and the frame is so low that an extraordinarily low temperature would have to be produced with the cooling jacket in order to permit the heat that is produced to be carried away from the periphery of the drum.

THE INVENTION

The invention is primarily addressed to the problem of constructing a centrifuge such that warming of the drum during operation will be largely prevented and the coolant can be recirculated. It is characterized by a known insert for insertion into the drum, said insert being supported at a plurality of points on the drum periphery and forming with the latter at least one passage for the temperature control medium, said passage being sealed from separating chamber of the drum, a calibrated bore being directed from the end of said passage against a cooling jacket disposed in the frame and surrounding the drum, and the coolant outlet being connected to the coolant inlet by a pumping system.

There are also liquids needing centrifugation which are kept at a low temperature to counteract the multiplication of bacteria. Such liquids are also centrifuged at low temperature and low throughput for the separation of the bacteria.

The invention is secondarily addressed to the problem of constructing the temperature controlling apparatus such that, when the coolant feed is shut off, the cooling passage or passages will automatically empty themselves under the effect of centrifugal force and will them be able to be filled with superheated steam. This makes it possible to kill within the drum the bacteria that have been removed by centrifugation, thus preventing infections.

In further development, the centrifuge of the invention is characterized by the fact that the calibrated bore is located where the temperature control passage or passages are farthest from the axis of rotation, and the coolant inlet can be changed over to superheated steam. Since the feed of material to be centrifuged must be shut off before changing over to superheated steam, the valves can be coupled together. It may also be desirable to shut off the cooling jacket disposed in the frame while the superheated steam is being delivered to the temperature control system.

SUMMARY

Thus, the invention provides a centrifuge with means for controlling the temperature of the material centrifuged, comprising a drum for the centrifuging which is rotatably mounted, a stationary frame jacket surrounding the drum and spaced therefrom, an inlet to the drum for introducing a material to be centrifuged, and an outlet for the liquid phase from which the specifically heavier material has been separated by centrifuging. The temperature control means comprises an insert disposed within and about the drum adjacent to the drum periphery and spaced therefrom providing passage for a heat exchange medium between the drum wall and the insert for controlling the temperature of material being centrifuged, and means sealing said passage from the drum interior. Inlet means and outlet means communicate with the passage for heat exchange medium for flow of the heat exchange medium through the passage. Heat transfer means are mounted on the stationary frame for controlling the temperature in the space between the drum and the frame. The outlet means from the insert communicates the passage for heat exchange medium with the space between the drum and frame, for flow of the heat exchange medium through said space for temperature control thereof. Means are provided for circulating said heat exchange medium between the passage for heat exchange medium in the drum and the space between the drum and the frame.

Desirably, in order to have automatic emptying of the passage between the insert and the drum when the flow of heat exchange medium is interrupted while the machine continues to run, the outlet means for the passage for heat exchange medium is disposed at the greatest distance between the passage and the axis of rotation of the centrifuge.

Also, it is desirable to provide the pipes for circulating the heat exchange medium with multi-way valves such that a cleaning fluid or superheated steam can be passed through the passage for heat exchange medium.

Two examples of the embodiment of the invention are shown in the drawing, differing in the manner in which the insert is sealed from the separating chamber of the drum.

Figure 2:
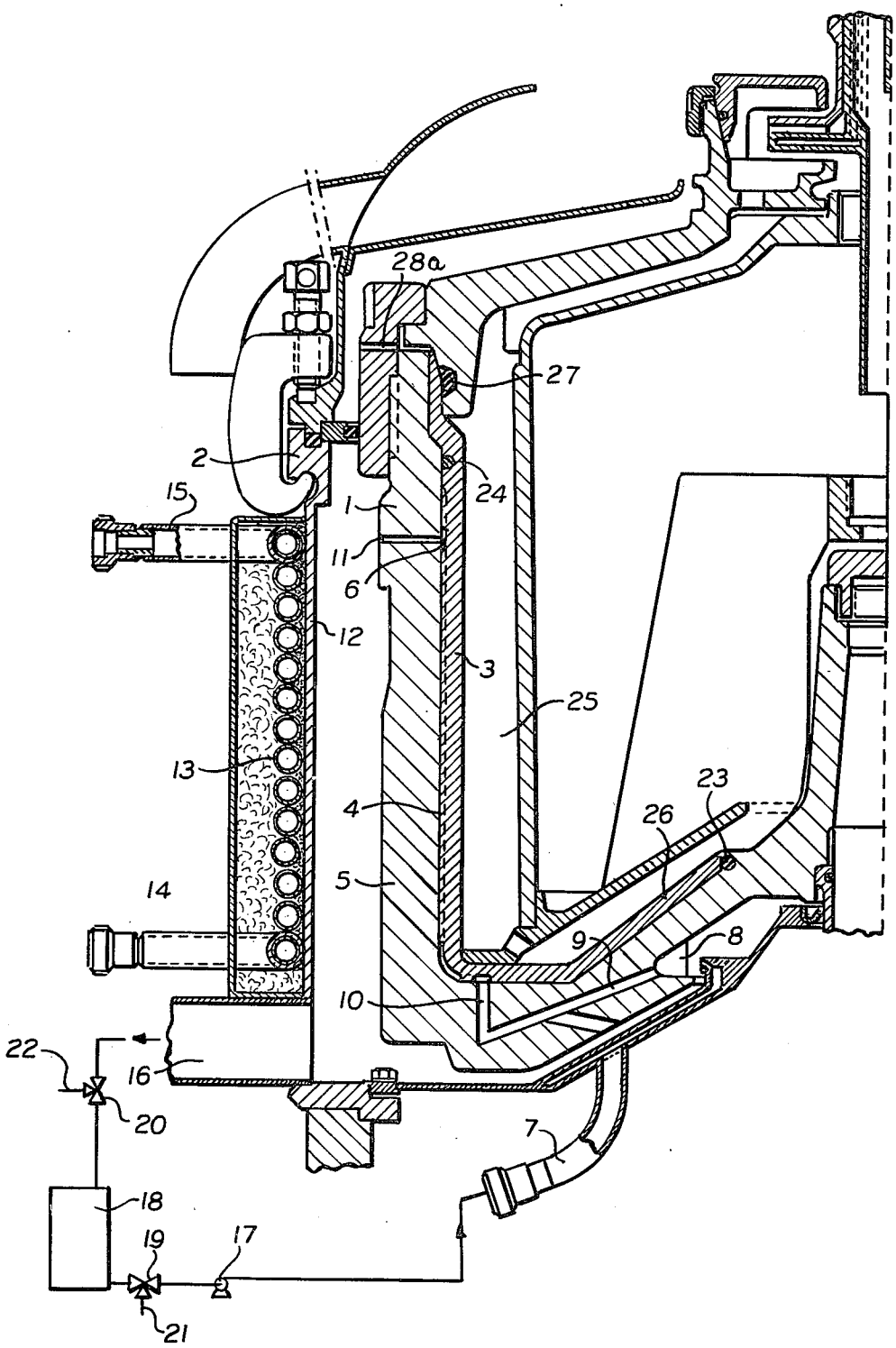

FIGS. 1 and 2 are vertical sections of centrifuges according to the invention.

Figure 1A:
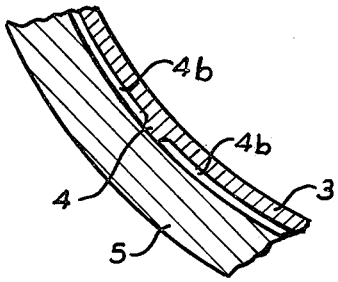

FIG. 1*a* is a section on line 1*a* — 1*a* in FIG. 1.

The drum is identified as 1 and the stationary frame surrounding it is identified as 2. The centrifugal is a precipitation centrifuge, i.e. the solid material which remains in the drum is centrifuged out of one liquid phase; two fluids are not centrifuged in the machine. The drum in both embodiments is a chamber drum. The drum is provided with an insert 3 which is supported against the drum periphery 5 by a plurality of axially extending, circumferentially spaced ribs 4 and circumferentially spaced lugs 4*a*, so that a plurality of passages 4*b* (FIG. 1*a*) is formed which are joined together by an annular groove 6. The temperature control medium is brought in through a line 7 and flows from the catcher trough 8 through passages 9 and 10 to the passages 4*b* behind the insert 3. There can be several passages 9, 10, e.g. one for each passageway between ribs 4. A calibrated bore 11 leads radially outwardly from the annular groove 6. Again, there may be several such passages. When a coolant is being fed, the coolant runs through the passages and then is sprayed against the cooling jacket 12 disposed on the stationary frame, the said cooling jacket being cooled by means of a cooling coil 13 which is provided with an inlet 14 and an outlet 15 for a coolant of its own, and has insulation 13*a*. The cooled coolant draining down from the cooling jacket 12 is driven by the air stream produced by the rotating drum to the floor drain 16 and is returned to the inlet 7 by means of a pump 17.

It is desirable to provide a reservoir 18 in which the coolant again collects. A three-way valve 19 with a shut-off position is inserted into line 7, and an ordinary three-way valve 20 is inserted into line 16. After the valve 19 has been closed, no more coolant is delivered, and with the machine running the cooling passages automatically empty through the calibrated bore 11 since the bore 11 is at the maximum distance of the passage 4*b* from the drum axis. After the valves 19 and 20 have been completely reversed, the temperature control passages can be supplied with superheated steam which enters through line 21 and leaves through line 22. To further explain the operation of the valves: Valve 19 has three positions, i.e. 1) flow from reservoir 18 to pump 17 only; 2) both flow from reservoir 18, and flow through line 21 shut off; 3) flow from steam line 21 to pump 17, only. Valve 20 has two positions, i.e. 1) flow from coolant discharge line 16 to reservoir 18, only; 2) flow from discharge line 16 to steam return line 22, only.

In the case of the drum of FIG. 1, the insert 3 is sealed against the separating chamber 25 of the drum by means of seals 23 and 24.

Since the coolant and coolant vapors flow through the space between the drum wall 5 and the stationary frame 2, any heating of the drum periphery even by external influence is counteracted.

In the embodiment represented in FIG. 2, the bottom radial flange 26 of the insert 3 extends further inwardly and the sealing ring 23 is moved to its inner edge. The upper axial flange of the insert is extended upwardly past the drum seal 27. This considerably reduces the danger that the coolant might become mixed with the liquid being centrifuged due to leaks in the sealing rings.

The reference character 28 is the catcher for overflowing liquid; 29 is the outlet pipe for overflowing liquid; 30 is the first chamber of the drum; 31 is the outer wall of the first chamber; and 32 is the axis of the drum.

What is claimed is:

1. A centrifuge for separating a specifically heavier material from a specifically lighter liquid phase with means for controlling the temperature of material centrifuged comprising a drum for the centrifuging which is rotatably mounted, a stationary frame jacket surrounding the drum and spaced therefrom, an inlet to the drum for introduction of material to be centrifuged, and an outlet for the liquid phase from which the specifically heavier material has been separated by centrifuging, said temperature control means comprising:

a. an insert disposed within and about the drum adjacent the drum periphery and supported on the drum walls at a plurality of circumferentially spaced locations and spaced therefrom providing passages for a heat exchange medium between the drum wall and the insert for controlling the temperature of material being centrifuged, and means sealing said passage from the drum interior, b. inlet means and outlet means communicating with said passage for flow of heat exchange medium through the passage, c. heat transfer means mounted on the stationary frame for controlling the temperature in the space between the drum and frame, d. said outlet means from the insert communicating the passage between the drum and insert with the space between the drum and frame for flow of the heat exchange medium through said space for temperature control thereof, and e. means for circulating said heat exchange medium which has passed through said space from said space to the inlet of said passage between the drum and insert.

2. Centrifuge of claim 1, wherein said outlet means from said passage for heat exchange medium is disposed at the greatest distance between said passage and the axis of rotation of the centrifuge, for automatic emptying of said passage when flow of heat exchange medium is shut off and the centrifuge continues to run.

3. Centrifuge of claim 2, the means for circulating heat exchange medium comprising pipes outfitted with multi-way valves such that a superheated steam can be passed through said passage for heat exchange medium.

4. Centrifuge of claim 1, wherein the support on the drum wall at said plurality of circumferentially spaced locations is provided by axially extending ribs.

5. Centrifuge of claim 2, wherein the support on the drum wall at said plurality of circumferentially spaced locations is provided by axially extending ribs.

6. Centrifuge of claim 3, wherein the support on the drum wall at said plurality of circumferentially spaced locations is provided by axially extending ribs.

* * * * *